US012092101B2

(12) United States Patent
Stephens et al.

(10) Patent No.: US 12,092,101 B2
(45) Date of Patent: Sep. 17, 2024

(54) SYSTEM AND METHOD OF USING POWER OF PUMP TO REPLACE PACKING BORES OR OTHER COMPONENTS FROM A FLUID END

(71) Applicant: FMC Technologies, Inc., Houston, TX (US)

(72) Inventors: Amy C. Stephens, Bluff Dale, TX (US); Cody Gill, Granbury, TX (US); Christopher Kowalski, Granbury, TX (US)

(73) Assignee: FMC Technologies, Inc., Houston, TX (US)

( * ) Notice: Subject to any disclaimer, the term of this patent is extended or adjusted under 35 U.S.C. 154(b) by 583 days.

(21) Appl. No.: 17/186,365

(22) Filed: Feb. 26, 2021

(65) Prior Publication Data

US 2021/0270263 A1 Sep. 2, 2021

Related U.S. Application Data

(60) Provisional application No. 62/982,379, filed on Feb. 27, 2020.

(51) Int. Cl.

| | |
|---|---|
| ***F04B 53/16*** | (2006.01) |
| ***F04B 17/00*** | (2006.01) |
| ***F04B 53/00*** | (2006.01) |
| ***F04B 53/22*** | (2006.01) |

(52) U.S. Cl.

CPC ..... *F04B 53/168* (2013.01); *F04B 17/00* (2013.01); *F04B 53/006* (2013.01); *F04B 53/22* (2013.01)

(58) Field of Classification Search

CPC ..... F04B 17/00; F04B 53/006; F04B 53/02; F04B 53/164–168; F04B 53/22

See application file for complete search history.

(56) References Cited

U.S. PATENT DOCUMENTS

| | | | | |
|---|---|---|---|---|
| 2,282,254 A * | 5/1942 | Shimer | F04B 53/168 92/171.1 |
| 2,717,186 A * | 9/1955 | Campbell | F04B 53/168 92/163 |
| 5,823,093 A * | 10/1998 | Kugelev | F04B 53/168 92/128 |
| 6,588,318 B2 * | 7/2003 | Aday | F04B 15/02 29/888.061 |
| 10,041,490 B1 * | 8/2018 | Jahnke | F04B 53/22 |
| 10,436,193 B1 * | 10/2019 | Jahnke | F04B 53/166 |
| 2017/0218932 A1 * | 8/2017 | Freed | F04B 39/14 |

* cited by examiner

*Primary Examiner* — Alexander B Comley

(74) *Attorney, Agent, or Firm* — Osha Bergman Watanabe & Burton LLP

(57) ABSTRACT

A reciprocating pump system for replacing a removable packing bore, the system includes a fluid end and a pump drive end. The fluid end includes a fluid inlet, a fluid outlet, a working barrel, a reciprocating member disposed in the working barrel, and the removable packing bore disposed within the working barrel. The pump drive end includes a gearbox integrally connected to a crankshaft, a crosshead, a transverse member configured to oscillate the reciprocating member of the fluid end in transverse motion. The removable packing bore and the transverse member are each configured to be connected to a packing bore connector.

6 Claims, 3 Drawing Sheets

SYSTEM AND METHOD OF USING POWER OF PUMP TO REPLACE PACKING BORES OR OTHER COMPONENTS FROM A FLUID END

FIELD

The disclosure relates to a system and a method for replacing packing bores in a fluid end of a pump using the power of the pump.

BACKGROUND

Across fracking and pumping industries, fluid end design is moving towards incorporating a removable packing bore. This removable packing bore replaces a used packing bore in a corresponding working barrel of a fluid end that is eroded or damaged during packing wash or any other operation, thus preventing the need to repair or replace the entire fluid end. However, once a packing bore is inserted into the corresponding working barrel, the packing bore can become lodged, and removing the lodged packing bore requires a large amount of force. In addition, the packing bore is generally shaped to close fit the corresponding working barrel, which makes it easily lodged within the fluid end if canted during installation or removal processes. Several solutions have been suggested to remove such lodged packing bores. However, these solutions require using jack bolts that may create misalignment between the removable packing bore and the working barrel, or a process that requires removal of the entire fluid end from the pump for the replacement process, which adds time and cost to the process.

SUMMARY OF THE CLAIMED EMBODIMENTS

Embodiments disclosed herein relate to a system and a method for replacing packing bores in a fluid end using power of pump to replace removable packing bores within working barrels of a fluid end in a reciprocating pump system. The method of using power of the pump allows operators to utilize the mechanical advantage of the pump to overcome any resisting force during replacement process, as well as keeping the packing bore in alignment with the corresponding working barrel, while avoiding the removal of the entire fluid end from the pump drive end for the replacement process.

In one aspect, embodiments disclosed herein relate to a reciprocating pump system comprising a fluid end and a pump drive end. The fluid end may include a fluid inlet, a fluid outlet, a working barrel, a reciprocating member disposed in the working barrel, such as a plunger or a piston, and a removable packing bore disposed within the working barrel. The pump drive end comprises a gearbox connected to a crankshaft, a crosshead, and a transverse member configured to oscillate the reciprocating member transversely. The removable packing bore and the transverse member may each be configured to be connected to a packing bore connector, which may facilitate removal of the packing bore from the working barrel when the packing bore is replaced.

In another embodiment disclosed herein is a packing bore connector comprising a first end and a second end. The first end may be configured to be connected to a packing bore, and the second end may be configured to be connected to a transverse member of a pump drive end in a reciprocating pump system.

In another embodiment disclosed herein is a method for replacing a packing bore. The method may include: attaching a packing bore connector to a removable packing bore disposed in a working barrel in a fluid end of a pump; and, attaching the packing bore connector to a transverse member of a drive end of the pump. The method may also include rotating a crankshaft in the pump drive end to move the transverse member and the attached packing bore, removing the packing bore from the fluid end.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
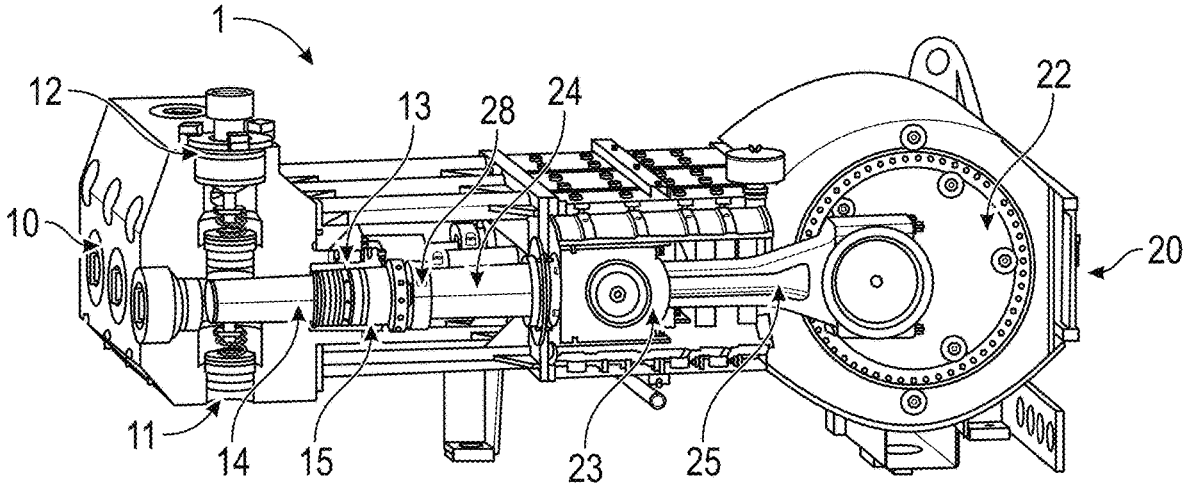
FIG. 1 shows a reciprocating pump system in accordance with one or more embodiments.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, well known features or processes associated with the hydrocarbon production systems have not been shown or described in detail to avoid unnecessarily obscuring descriptions of the implementations and embodiments. For the sake of continuity, and in the interest of conciseness, same or similar reference characters may be used for same or similar objects in multiple figures.

Embodiments disclosed herein relate to a reciprocating pump system that may include a fluid end and a power drive end. The fluid end may be subject to high stress due to extreme environments and fluids being conveyed, such as frac sands, high pressures, recycled water, chemicals, and slick water frac. The extreme conditions encountered, such as during frac operations, may contribute to fluid end failure in as little as 100 to 500 pumping hours in many of the fracking and pumping applications. Life cycles of the fluid end may be extended by replacing packing bores with removable packing bores, such that when a removable packing bore is damaged, only the damaged removable packing bore is replaced, instead of replacing the entire fluid end of the pump.

In accordance with some embodiments disclosed herein, FIG. 1 shows a reciprocating pump system 1 having a fluid end 10 and a pump drive end 20. The fluid end 10 is responsible for delivering pressurized and pumped fluid, such as into a well, and may be made of stainless steel or high strength materials with coatings that will give corrosion protection to the fluid end 10. The fluid end 10 may include a fluid inlet 11, a fluid outlet 12, a working barrel 13, a reciprocating member 14, and a removable packing bore 15. The reciprocating member 14 may be disposed in the working barrel 13, and the reciprocating member 14 may be configured to oscillate transversely to provide pressure to the fluid end 10 and to control the flow in the fluid inlet 11 and outlet 12 of the fluid end 10. To carry out such function, the reciprocating member 14 may be selected from a group of pony rods, plungers, piston, etc., which are made of high-strength materials to withstand high pressure in transverse direction and sealing materials on the contact surface with the working barrel 13, leaving no gap between the reciprocating member 14 and the working barrel 13.

The pump drive end 20 in the reciprocating pump system 1 may include a gearbox 21, a crosshead 23, and a transverse member 24 configured to oscillate the reciprocating member 14 transversely within the working barrel 13. The gearbox 21 may include a set of gears with different sizes that can be switched interchangeably and interlocked with the crankshaft 22, and may transform the angular momentum generated by the gearbox 21 to the transverse momentum of the transverse member 24 through the crankshaft 22. In other words, the transverse member 24 of the pump drive end 20 is configured to oscillate transversely in accordance with strokes generated by the crankshaft 22.

As a non-limiting example, a gearbox 21 may include a set of gears of ratio from 1:1 to 1:7, which controls the power ratio between a motor of the pump drive end 20 and the actual pumping power of the reciprocating member 14 within the working barrel 13 in the fluid end 10. This power ratio can be controlled by switching gears in the gearbox 21 in order to control the speed, power, and other characteristics of the motion of transverse member 24. The transverse member 24 (e.g., pony rod) may be connected to the reciprocating member 14 (e.g., plunger), for example, using a plunger clamp 28.

The removable packing bore may be disposed within the working barrel, as noted above, to provide sealing around the reciprocating member and to seal against an inner surface of the working barrel. To facilitate removal of the removable packing bore from the working barrel, removable packing bores according to embodiments herein may include a terminal end that is connectable to a packing bore connector, described further below.

Figure 2:
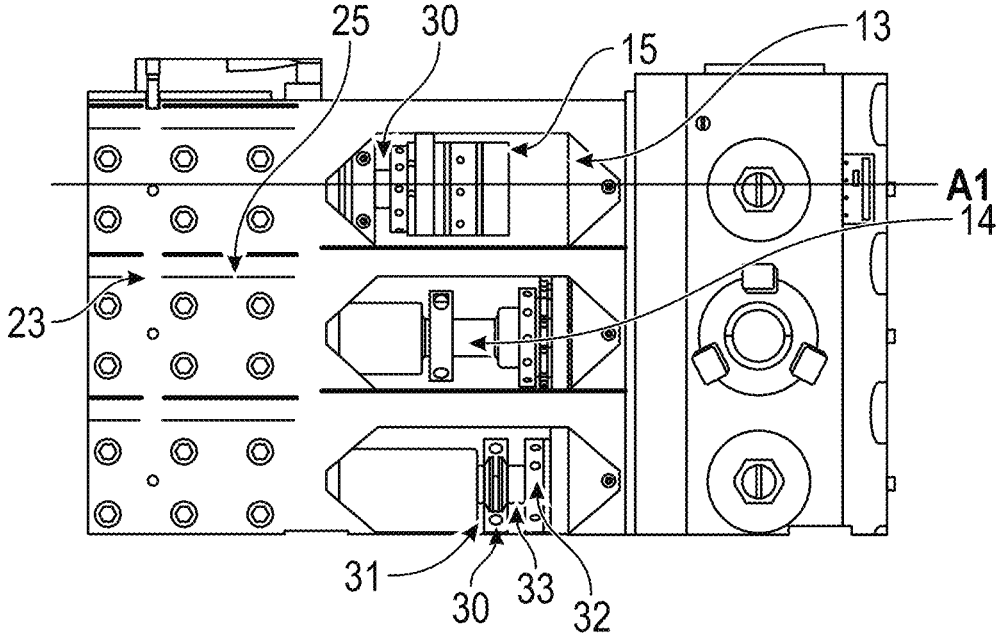
FIG. 2 shows a top view of a reciprocating pump system in accordance with one or more embodiments.

When it is necessary or desired to replace the packing bore according to embodiments herein, a packing bore connector according to embodiments herein may be connected to a transverse reciprocating member, such as the crosshead 23 or a transverse member 24 (pony rod). For example, referring now to FIG. 2, a packing bore connector 30 may include a first end 31 and a second end 32 that are used to connect packing bore connector to each of the removable packing bore 15 and the transverse member 24, thereby allowing both the removable packing bore 15 and the transverse member 24 to move together. The packing bore connector 30 may include connections at ends 31, 32 that may include one or more of clamps, bolts and nuts, threads, hydraulics, cams, suction, magnets, etc. For example, the first end 31 of the packing bore connector 30 may be connected to the transverse member 24 of a pump drive end 20 by a clamp, while the second end 32 of the packing bore connector 30 may be connected to the removable packing bore 15 by a flange in accordance with some embodiments, as shown in FIG. 2. A packing bore connector 30 in accordance with other embodiments may be customized to have other compatible interfaces with the transverse member 24 or crosshead 23 and the removable packing bore 15. A connection may be made between a transverse reciprocating member (pony rod or crosshead) with the pump at or near full stroke, for example. Then, the pump may be rotated to move the transverse reciprocating member on a return stroke, away from the fluid end, withdrawing the removable packing bore from the working barrel, as shown along axis A1 of FIG. 2. The packing bore connector may further include a spool portion 33. Spool portion 33, as well as second end connector 32 may have an inner diameter, for example, that may fit around an end of the plunger or piston rod, thereby not requiring removal of the piston rod during packing bore replacement.

The crosshead 23 section of the reciprocating pump system 1 limits the motion of the transverse member 24 only in transverse direction by providing a slider-crank linkage 25 that guides the motion of the transverse member 24 and eliminates sideways pressure on the reciprocating member 14. This ensures that the reciprocating member 14 oscillates transversely with the transverse member 24 along a longitudinal axis A1 of the working barrel 13. Connection of the removable packing bore to the transverse reciprocating member 14 or the crosshead 23 may thus avoid any undesired friction or canting between the working barrel 13 and the removable packing bore during the packing bore removal process. Such undesired friction or canting may otherwise cause misalignment between the longitudinal axis of the working barrel 13 and the packing bore, potentially damaging the working barrel or making removal of the packing bore more difficult. One skilled in the art would appreciate how the alignment between the removable packing bore 15 and the working barrel 13 along the longitudinal axis A1 is maintained through the use of transverse motion of the transverse member 14, allowing efficient and effective removal of packing bores according to embodiments herein.

In accordance with one or more embodiments disclosed herein, a reciprocating pump system 1 may further include a handle 26 (FIG. 3) that is integrally connected to the crankshaft 22 to manually control strokes in the crankshaft 22 to move the transverse member 24 to a desired location. For example, an operator may control the gears in the gearbox 21 to control the speed and power of the motion of the transverse member 24 to remove a removable packing bore 15 within the corresponding working barrel 13 in the fluid end 10. The operator may further move the transverse member 24 to a desired location by controlling the handle 26, such that connection of the connector 30 to the transverse reciprocating member 24 and the removable packing bore may be facilitated. This may ensure the capability of an operator to control the motion of the transverse member 24 during a packing bore replacement procedure.

The pump drive end 20 further comprises a spacer section 42 that provides a space to allow a replacement process of the removable packing bore 15 in the fluid end 10. The spacer section 42 may include supports that connect between the pump drive end 20 and the fluid end 10. Spaces between the supports allow operators to physically access the removable packing bore 15 and perform replacement processes without detaching the fluid end 10 from the pump drive end 20.

As described above, pump systems according to embodiments herein may thus include a removable packing bore disposed within a working barrel. The removable packing bore may be configured to be connectable to a packing bore removal tool. The packing bore removal tool may be configured to attached to a transverse reciprocating member of the pump, such as a crosshead or a pony rod, for example. The power of the pump may then be used to withdraw the removable packing bore from the working barrel without canting the packing bore.

A method for replacing a packing bore according to embodiments herein may include attaching a packing bore connector 30 to a packing bore disposed in a working barrel 13 in a fluid end 10. The packing bore connector 30 may also be connected to a transverse member 24 of a pump drive end 20. Rotating the crankshaft 22 in the pump drive end 20 may then move the transverse member 24 and the attached packing bore, thereby removing the packing bore from the fluid end 10. Prior to attaching the packing bore connector to a packing bore, as recognized by one skilled in the art, the connections between the pony rod and the plunger may be disconnected, as well as removing any end caps or other connections so as to provide access to the packing bore.

The packing bore connector 30 may be attached to the exposed tip of a used packing bore disposed in a working barrel 13 in a fluid end 10. The packing bore connector 30 is further attached to a longitudinal end of the transverse member 24 (i.e., the end that is not connected to the crankshaft 22). When all three of the transverse member 24, the packing bore connector 30, and the used packing bore are connected, the pump drive end 20 is powered to rotate the crankshaft 22 to move the transverse member 24 and the attached packing bore, thus removing the packing bore from the corresponding working barrel 13. Alternatively, the handle 26 may be used to manually oscillate the transverse member 24 and withdraw the packing bore from the working barrel.

One skilled in the art will appreciate how the method disclosed herein utilizes power of the pump for replacing the removable packing bore without removing the entire fluid end 10 from the pump drive end 20. This further eliminates use of other tools to overcome the resistance force due to lodging during the removal process.

In accordance with one or more embodiments disclosed herein, a method for replacing packing bores may further include inserting a new packing bore into the corresponding working barrel 13 using the packing bore connector. This may further ensure that the new packing bore is inserted in alignment with the longitudinal axis A1 of the working barrel 13, avoiding any unwanted angular movement or friction inside the working barrel 13.

Figure 3:
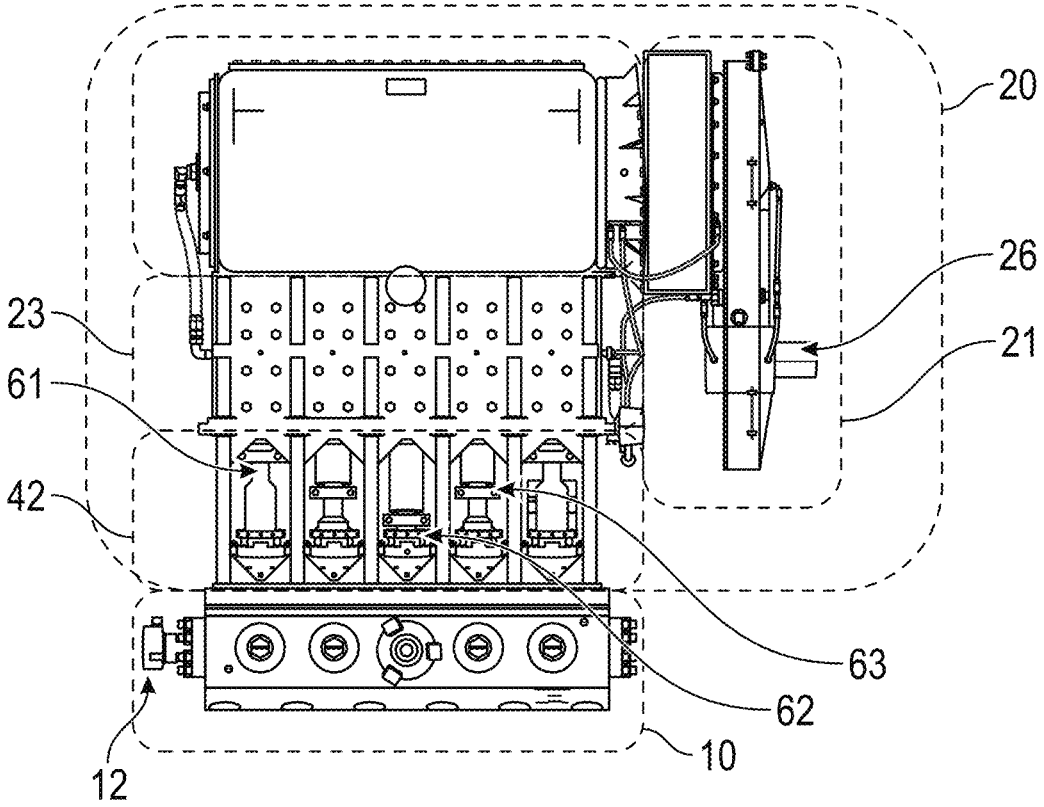
FIG. 3 shows a top view of a reciprocating pump system showing different stroke levels in accordance with one or more embodiments.

For example, FIG. 3 shows the transverse member 24 in full stroke 62, zero stroke 61, and half stroke 63. An operator may run the pump drive end 20 to rotate the crankshaft 22, associated with a working barrel having a packing bore to be replaced, to full stroke 62. The above-described connections and disconnections may then be made, and the pump rotated to zero stroke 61 in order to take a used removable packing bore out of the fluid end 10. The old packing bore may then be removed from the packing bore connector, and replaced with a new removable packing bore, after which the operator may run the pump drive end 20 to rotate the crank shaft to full stroke 62 in order to insert the new removable packing bore into the working barrel 13. In case that the operator fails to stop the strokes in a desired position, such as when the transverse member 24 is stopped at half stroke 63, an operator may control the handle 26 to further manipulate the crankshaft in order to move the transverse member 24 to the desired location.

As described above, embodiments herein may use the power end to remove the replaceable member from the fluid end. In some embodiments, once the plunger clamps, plunger, and adjusting nut have been removed from the fluid end, the pony rod can be connected to the replaceable packing bore or other replaceable members using a variety of methods, including threads, bolts, clamps, magnets, etc. The pump can then be rotated at the input hub using a variety of methods, including manually turning it or using the motor that is attached for typical operation. The pony rod can be attached to the replaceable packing bore while the pony rod is at or near full stroke so that rotation of the input hub will cause the pony rod to travel away from the fluid end. This movement causes the packing bore to be pulled from the fluid end without canting and without removing the fluid end from the power end. Once the pony rod is appropriately retracted, the replaceable packing bore can be disconnected from the pony rod and to allow for the installation of the replacement part.

Advantageously, embodiments herein allow the packing bore to be removed without removing the fluid end from the pump. Removing the fluid end requires substantial time as well as hoisting the fluid end, which in turn requires specialized equipment and the added risk to personnel of hanging loads. It also requires equipment such as an overhead crane, which may not be present in a field environment, and would thus require relocating the pump to a shop environment for packing bore removal. Allowing the removal of the packing bore without the removal of the fluid end allows this maintenance to be easily performed in a field environment, and which may be performed with just the use of hand held tools in some embodiments.

The methods and systems described herein also allows the packing bore to be removed without imparting an angular force on the replaceable packing bore. An angular force will cause the packing to cant and lodge within the bore.

The described method also allows the substantial mechanical advantage of the pump gear ratio (such as 7:1) to be used to apply force to remove the removable packing bore. The packing bores are intended to be removed after damage. Such damage can expand the bore, create fractures, or allow the intrusion of solids which will cause the packing bore to become lodged in the fluid end. The ability to use the pump gear ratio advantageously facilitates removal of lodged packing bores.

As described above, embodiments herein may use a pony rod to connect a packing bore removal tool to the removable packing bore and the drive end of the pump. Rather than connecting to the pony rods, embodiments herein also contemplate that the replaceable packing bore may be connected to other portions of the pump that move in a transverse motion, such as the cross head, while maintaining the above-noted advantages, such as no canting and use of the gear ratio to facilitate removal.

While the invention has been described with respect to a limited number of embodiments, those skilled in the art, having the benefit of this disclosure, will appreciate that other embodiments can be devised that do not depart from the scope of the invention as described herein. Accordingly, the scope of the invention should be limited only by the accompanying claims.

What is claimed:

1. A method for replacing a packing bore, the method comprising:

attaching a packing bore connector to a packing bore disposed in a working barrel in a fluid end of a pump;

attaching the packing bore connector to a transverse member of a drive end of the pump;

wherein the packing bore connector is attached to the packing bore and the transverse member by physically accessing, through a space, a spacer section of the pump between the fluid end and the drive end of the pump without detaching the fluid end from the drive end;

rotating a crankshaft in the pump drive end to move the transverse member and the attached packing bore; and removing the packing bore from the fluid end.

2. The method of claim 1, further comprising, prior to attaching the packing bore connector to the packing bore, disconnecting the transverse member of the pump drive end from a reciprocating member of the pump fluid end.

3. The method of claim 1, further comprising disposing a new packing bore in the working barrel.

4. The method of claim 3, wherein disposing the new packing bore in the working barrel comprises:

disconnecting the packing bore from the packing bore connector;

connecting the new packing bore to the packing bore connector; and rotating the crankshaft to insert the new packing bore into the working barrel.

5. The method of claim 1, further comprising using a handle that is connected to the crankshaft to manually control strokes in the crankshaft to move the transverse member.

6. The method of claim 1, further comprising controlling a gearbox connected to the crankshaft to control a speed and power of the transverse member.

* * * * *